US007254973B2

(12) United States Patent
Campian

(10) Patent No.: US 7,254,973 B2
(45) Date of Patent: Aug. 14, 2007

(54) ROLLER TOOL AND POSITIONAL PRESSURE METHOD OF USE FOR THE FORMING AND JOINING OF SHEET MATERIAL

(75) Inventor: Jonathon Reo Campian, Troy, MI (US)

(73) Assignee: Modern Body Engineering Corporation, Madison Heights, MI (US)

( * ) Notice: Subject to any disclaimer, the term of this patent is extended or adjusted under 35 U.S.C. 154(b) by 0 days.

(21) Appl. No.: 10/521,655

(22) PCT Filed: Nov. 19, 2004

(86) PCT No.: PCT/US2004/038993

§ 371 (c)(1),
(2), (4) Date: Jan. 14, 2005

(87) PCT Pub. No.: WO2005/060493

PCT Pub. Date: Jul. 7, 2005

(65) Prior Publication Data

US 2006/0107719 A1 May 25, 2006

(51) Int. Cl.
*B21D 39/02* (2006.01)

(52) U.S. Cl. ..... 72/220; 72/210; 72/214; 72/246; 29/243.58

(58) Field of Classification Search ..... 72/81, 72/210, 214, 220, 306; 29/243.57, 243.58
See application file for complete search history.

(56) References Cited

U.S. PATENT DOCUMENTS

| | | | | |
|---|---|---|---|---|
| 4,565,081 | A * | 1/1986 | Massee | 72/20.2 |
| 5,228,190 | A | 7/1993 | Sawa | 29/715 |
| 5,237,734 | A * | 8/1993 | Polon | 29/513 |
| 6,694,793 | B1 | 2/2004 | Persson | 72/220 |
| 2005/0217339 | A1 * | 10/2005 | Toeniskoetter | 72/220 |

* cited by examiner

*Primary Examiner*—Dmitry Suhol
(74) *Attorney, Agent, or Firm*—Butzel Long

(57) ABSTRACT

An apparatus and method for forming and joining a first sheet material (A) located in a nest (30) to a second sheet material (B) positioned on top of the first sheet material. The apparatus includes a positional pressure roller tool or positional pressure variance unit (50) for performing the forming and joining operations. The PPVU (50) may include both a main roller (58) and a touch-up roller (60). The PPVU (50) is operatively associated with a programmable positioning apparatus in the form of a robotic arm (52) and a machine cell (10) whereby the position of the robotic arm (52) relative to the nest (30) dictates the applied pressure at the interface between the roller (72) and the nest (30).

8 Claims, 2 Drawing Sheets

ROLLER TOOL AND POSITIONAL PRESSURE METHOD OF USE FOR THE FORMING AND JOINING OF SHEET MATERIAL

FIELD OF THE INVENTION

The present invention relates to systems for forming and joining a first sheet material to a second sheet material. More particularly, the present invention relates to a pressure-controlled roller tool and method of use in the forming and joining of sheet material.

DESCRIPTION OF THE RELEVANT ART

One of the earliest operations required in the history of automobile assembly was the joining of an inner panel to an outer panel to form any of a variety of body parts, including doors, engine hoods, fuel tank doors and trunk lids, all referred to as "swing panels" which encase the vehicle frame. Known machines for the forming and joining of sheet materials include the press-and-die set, the tabletop and the roller-forming tool, the latter being the most-recently introduced device.

An unfortunate feature of forming and joining materials with the roller-forming tool is the difficulty in controlling the variable pressures required by the tool. A certain approach has been undertaken to overcome this problem.

One known effort to control the variable pressures required by a roller-forming tool to form sheet material is the employment of an air bladder for mechanical compliance sandwiched between the faceplate of a robotic arm and the roller-tool in conjunction with a closed loop pneumatic pressure feedback circuit that dynamically controls the pressure of the bladder. This technique was developed during the era of on-line robotic path programming, and low speed operation.

The robotic arm maneuvers the bladder and roller-tool along the variable terrain of the sheet material while maintaining a constant distance between the faceplate of the robotic arm and the sheet material surface. When a change in pressure at the roller-tool is commanded, or an imbalance is detected in the closed loop feedback circuit, the bladder pressure is altered to compensate.

However, the reaction time for pneumatic compressions and decompressions required for stabilization is finite, limiting the speed of a roller-forming tool equipped with a pneumatic system to 200 mm/sec. This speed limitation allows for what is known in the art as low volume production only.

Another known effort to control the variable pressures of existing systems has been to use servo motor amperage feed back sampling directly from the controller of the robotic arm. However, this sampling does not allow for mechanical compliance of either the forming tool or the servo positioning system. This latter approach is clearly the least desirable.

Accordingly, prior approaches have failed to solve the speed limit problem associated with the control of the variable pressures required when forming and joining sheet materials at speeds over 200 mm/sec.

SUMMARY OF THE PRESENT INVENTION

It is thus the general object of the present invention to provide an apparatus and method that overcomes the problems of known techniques for forming and joining a first sheet material to a second sheet material to form a swing panel for an automobile.

It is a particular object of the present invention to provide a positional pressure roller tool for forming and joining a first sheet material to a second sheet material that includes an expeditious method for controlling the variable pressures of the tool.

It is a further object of the present invention to provide such a positional pressure roller tool, which may include both a main roller and a touch-up roller.

Another object of the present invention is to provide such a positional pressure roller tool that is flexible enough to accommodate panels of various sizes, shapes, and contours.

A further object of the present invention is to provide such a positional pressure roller tool that may be used in conjunction with a robotic arm in operation with a variety of machine cells.

These and other objectives are achieved by the provision of a positional pressure roller tool which is operatively associated with a programmable positioning apparatus in the form of a robotic arm and a machine cell which includes a holder for a first panel in the form of a lower nest, and a holder for a second panel in the form of an upper gate. The positional pressure roller tool or positional-pressure-variance-unit ["PPVU"] includes a cylinder head with a captured reciprocating piston and shaft. A biasing element in the form of a compression spring is located inside the cylinder and atop the piston. The biasing element urges the piston to an extended position. Forming steels and roller-forming tools are also attached to the end of the shaft.

A pair of married sheet materials, A and B, is approximated onto the lower nest. The first sheet material A is then precision positioned by means of crowders. The upper gate thereafter aligns the second sheet material B with respect to the first sheet material A by known means. The first sheet material A is then securely held in place either by known means or by a vacuum system such as disclosed and claimed in PCT/US04/34238, incorporated by reference herein.

Thus held in place, a seaming operation executes, forming and joining the first sheet material A to the second sheet material B by means of the roller-forming tools attached to the PPVU. A positional program of the robotic arm orientates the PPVU in a generally perpendicular attitude with respect to the surface normal of the lower nest shape at the roller-forming tool contact point. The programmably positioned distance between the robotic arm's faceplate and the lower nest dictates the pressure applied to the surface of the sheet material. The distance is such that the spring will compress and exert a quantitative force back through the roller-forming tool.

This force exerted by the PPVU is countered by the robotic arm, which inherently exhibits flexing of the steel structure comprising its body, and backlash movement within the gearing comprising its mechanical knuckles.

Robotic flexing and backlash introduces positional error. This error is the deviation between the physical position of the PPVU and that of the programmed position. Thus, programmed error compensation is required.

The combined errors are recorded and charted at sequential coordinates as the robot reaches away from itself, and at sequential pressures that would be used to form sheet material. The chart is built into an algorithm and used to compensate for deviation errors in the positional pressure programming of the PPVU.

Once the pressures are established, the positional program controls the robotic arm such that the distance between the faceplate and the lower nest is variably controlled while the roller-forming tool drives along the seams of sheet material A to be formed and joined. The roller-forming tool pressure-forms material A to lay over material B while being supported by the lower nest. Once all the seams are formed, the joining operation is complete.

These and other objectives are accomplished by the provision of an apparatus and method for the forming and joining of sheet material as set forth hereinafter.

BRIEF DESCRIPTION OF THE DRAWINGS

The present invention will be more fully understood by reference to the following detailed description of the preferred embodiments when read in conjunction with the accompanying drawings, in which like reference characters refer to like parts throughout the views, and in which.

DETAILED DESCRIPTION OF A PREFERRED EMBODIMENT OF THE PRESENT INVENTION

The drawings disclose the preferred embodiment of the present invention. While the configurations according to the illustrated embodiment are preferred, it is envisioned that alternate configurations of the present invention may be adopted without deviating from the invention as portrayed. The preferred embodiment is discussed hereafter.

Figure 1:
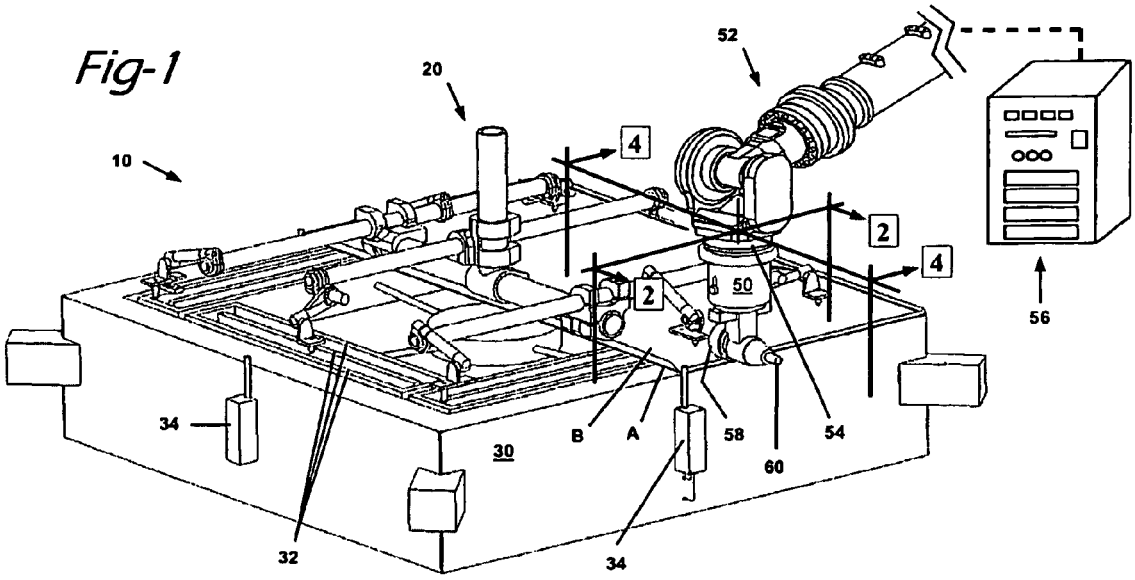
FIG. 1 is a perspective view of a machine cell incorporating a positional pressure roller tool assembly according to the preferred embodiment of the present invention.

With reference first to FIG. 1, the preferred embodiment of a machine cell, generally referenced as 10, is illustrated in a perspective view. The machine cell 10 includes an upper gate 20 and a lower nest 30. It should be understood that the configuration of the machine cell 10 as illustrated is preferred, but is not to be interpreted as limiting as other configurations conceivable to those skilled in the art may also be suitable.

The machine cell 10 holds two portions of sheet material so that a joining process may be undertaken without the sheet material portions being caused to shift or otherwise move out of position. The two portions of sheet material include a first sheet material A and a second sheet material B. The two sheets A and B, in a combination resulting from seaming, form an integrated component, of which the first sheet material A forms the outer part or the skin and the second sheet material B forms the inner part or the support structure. (Sheets A and B are illustrated in combination in FIG. 6, discussed below.) As illustrated, the first sheet material A and the second sheet material B have a generally square configuration resulting in a generally square-shaped integrated component. However, it is to be understood that other shapes may be suitable for use in the present invention.

The sheet materials A, B are captured and held between the upper gate 20 and the lower nest 30. In brief, the sheet materials A, B are approximated onto the lower nest 30. The lower nest 30 includes a nest surface 32 that is fluidly connected to a vacuum source (not shown). The first sheet material A is then precision positioned by means of crowders 34. Thereafter the upper gate 20 is lowered by a robotic arm or linear slide to a precise location. The gate aligns the second sheet material B with respect to the first sheet material A by way of alignment pins from the gate engaging master locating holes in material B. The first sheet material A is then held in place by a vacuum applied to its under side.

Thus held in place, a seaming operation is executed for forming and joining the first sheet material A to the second sheet material B by means of the roller tool. FIG. 1 illustrates the PPVU as an assembly 50 in operational association with a robotic arm 52. The PPVU assembly 50 mounts rigid to a robotic arm faceplate 54 that is rotatably connected to the robotic arm 52. The robotic arm 52 is itself in operative association with a computer 56. The computer 56 preferably effects movement of the robotic arm 52 by a specific program as will be discussed further below. The PPVU assembly 50 includes a main roller tool 58 and a touch-up roller tool 60. Thus mounted through the PPVU assembly 50 to the rotatably attached faceplate 54 the main roller tool 58 and the touch-up roller tool 60 may be rotatably selected depending upon the desired operation.

Figure 2:
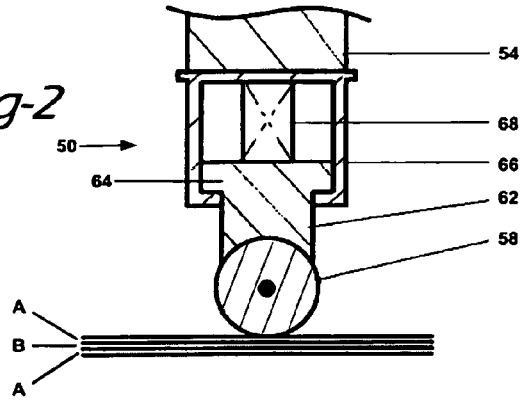
FIG. 2 is a sectional view of the roller tool assembly of the present invention taken along lines 2-2, viewed from the side of the main roller and illustrating the piston in its substantially unloaded, fully extended position.
Figure 3:
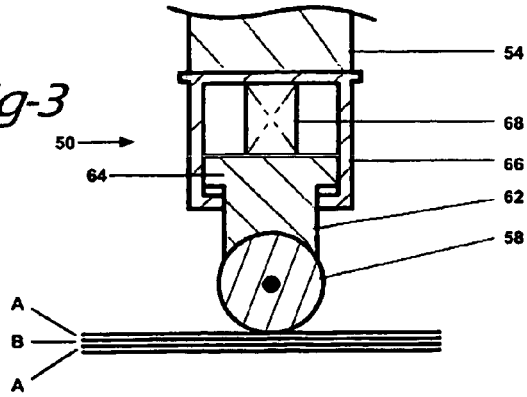
FIG. 3 is a sectional view of the roller tool assembly of the present invention similar to that of FIG. 2 but illustrating the piston in its substantially loaded, partially extended position.
Figure 4:
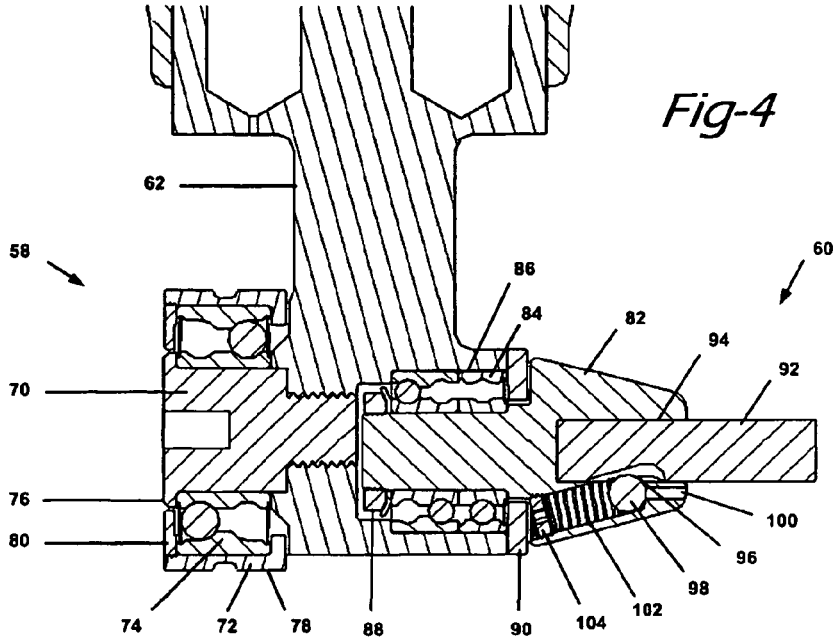
FIG. 4 is a sectional view of the roller assembly taken along lines 4-4, showing the main roller and the touch-up roller, both rollers having parallel axles that are rotatably mounted through the piston shaft, the figure being taken axially along the parallel axles.

A cross-section of the main roller tool 58 is shown in both FIG. 2 and FIG. 3. A cross-section of the roller assembly 50 is shown in FIG. 4 and illustrates both the main roller tool 58 and the touch-up roller tool 60. With respect to these figures, the main roller tool 58 is generally and operatively mounted to the faceplate 54 by a reciprocating hub 62 having a piston end 64 mounted in a cylinder 66. The cylinder 66 is fitted rigid to the faceplate 54 of the robotic arm as is known in the art. Biasing element or spring 68 biases the piston end 64 away from the end wall of the cylinder 66. As an alternative to the use of the illustrated spring biasing element 68 a gas-charged cylinder may be placed in the position of the spring 68 to execute the needed biasing. In this manner, the PPVU assembly 50 provides a positional pressure roller tool whereby the position of the robot arm faceplate 54 relative to the lower nest 30 dictates the applied pressure at the interface between seam S and the wear surface 78 of the roller 72.

The main roller tool 58 includes an axle 70 fixedly mounted in the hub 62. A main roller 72 is rotatably mounted on the axle 70 by a main bearing 74. The axle 70 includes a main roller support flange 76 that retains the main bearing 74 against the hub 62. The outer diameter of the main roller 72 may be of a variety of sizes but is preferably of the 90 mm size which is known in the art as being a standard size.

Referring particularly to FIG. 4, the main roller 72 includes a hardened wear surface 78. A face plate 80 is threaded to the main roller 72 thus locking the hardened wear surface 78 in place with respect to the main bearing 74.

The touch-up roller tool 60 includes a spindle 82 that is rotatably carried by the hub 62 by way of an array of bearings 84. The bearings 84 are disposed within a pocket 86 defined into the hub 62. A locking member 88 is threadably attached to one end of the spindle 82 thus capturing the bearings 84 there between. The bearings 84 are themselves retained in the hub 62 by a faceplate 90 that is screwed to the hub 62.

A tool insert 92 is slidingly positionable within an aperture 94 defined in the end of the spindle 82 opposite the threaded end onto which the locking member 88 is attached. The tool insert 92 slip fits into the aperture 94 and is selectively locked in place with a ball lock interface 96. The ball lock is an industry standard configuration that allows the tool insert to be removed by pushing a ball bearing 98 via an access hole 100 back into and compressing a spring 102 against a retaining plug 104 prior to removal. The outer diameter of the tool 92 may be of a variety of sizes but is preferably of the 20 mm size which is known in the art as being a standard size. As is also known in the art the tool insert 92 may be stepped and may have two or more surfaces of different diameters.

The main roller tool 58 and the touch-up roller tool 60 operate in conjunction with the robotic arm and the pressure system of the present invention. When no pressure is applied to the materials to be joined the biasing element 68 of the roller assembly 50 urges the piston end 64 in its outwardly extended position. Conversely, when pressure is selectively applied to the roller assembly 50 by means of the robotic arm the piston end 64 may be reciprocatingly urged into the cylinder 66 by the opposing force of the material being formed. The biasing element (or gas-charged cylinder) 68 acts to resist the inward movement of the piston end 64.

The bias of element (or gas-charged cylinder) 68 is linearly proportional to piston end 64. Each unit of linear distance piston end 64 moves into cylinder 66 will increase the bias of element 68 in a linear proportion. In the event that a gas-filled cylinder is used in lieu of the spring 68 a charge is built up therein and the piston end 64 moves into cylinder 66. This linear relationship is the basis for the positional pressure variance programming that the robotic arm plays.

Operation

The operation of the machine cell 10 will now be generally described. As the operation begins the upper gate 20 should already be in its elevated position, assuming that a seaming operation has already been completed and the seamed part has been removed, thus leaving the lower nest 30 empty.

Figure 5:
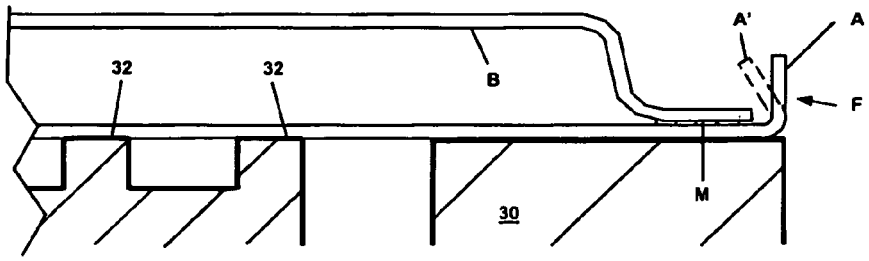
FIG. 5 is a sectional view of the sheet materials taken along lines 4-4 of FIG. 1 illustrating the materials in their positions prior to complete forming.

Initially a known quantity of mastic ("M" as shown in FIG. 5) is applied to the approximate surface areas at which the first sheet material A will be joined to the second sheet material B. The mastic is utilized to provide a more complete joining of the sheet materials. The mastic may be joined to one of the sheets or to both as may be desired. Known mastics may include glass bead-filled compositions as are known in the art.

The machine cell 10 may then be operated by a human operator or by a programmable logic controller as is known in the art. Regardless of the form of the operator, reference shall be made hereafter generically to "the operator."

Once the mastic has been selectively applied to sheets A and B, the operator marries the first sheet material A to the second sheet material B, then places the combined sheets on the nest surface 32 with the first sheet material A face down (that is, the outer surface of the sheet material A is placed onto the nest surface 32). The crowder assemblies 34 (two crowders are illustrated but it should be understood that there is preferably one or more crowder for each side) are then activated by operation of a second air pressure source to advance the alignment fingers to their engaged and aligning positions. So engaged, the first sheet metal A is in alignment relative to the nest surface 32. This arrangement facilitates positive micro-positioning of the first sheet material A.

The operator then engages the robotic arm or linear slide (neither shown) to lower the upper gate 20 into an engaged position with material B. The robotic control provides that movement of the upper gate 20 with a precise attitude.

Once the first sheet material A is in position, a vacuum source is activated to provide a vacuum between the surface of the first sheet material A and a plurality of vacuum channels (not shown). The first sheet material A is thus immobilized. With the combined assembly of the first sheet material A and the second sheet material B secured within the machine cell 10, an air pressure source (not shown) is activated and the fingers of the crowder assemblies 34 are drawn away from their illustrated aligning positions to substantially horizontal positions. Thus positioned, the fingers will not interfere with the subsequent forming operation.

Figure 6:
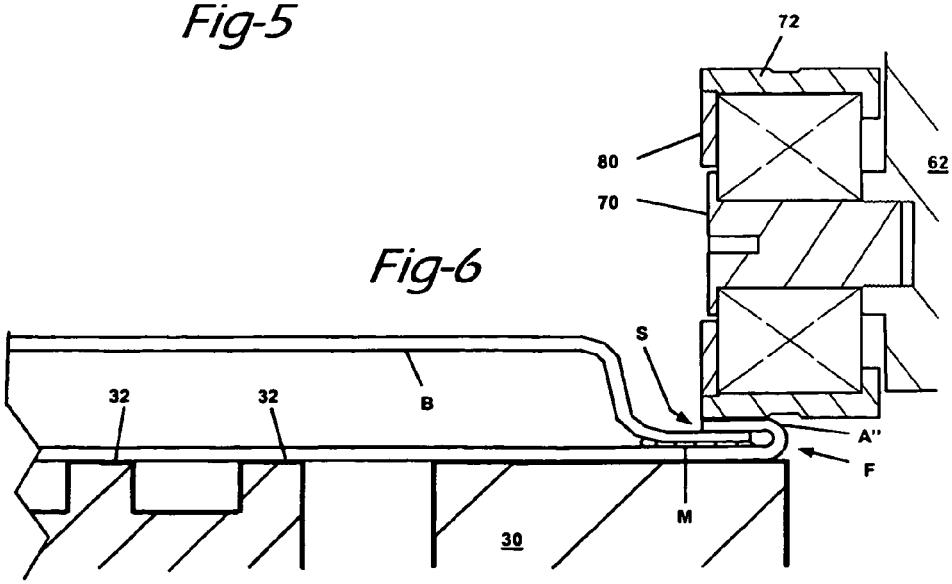
FIG. 6 is a view similar to that of FIG. 5 but illustrating the materials in their formed positions.

The forming operation then occurs by which a seam is formed around the periphery of the combined unit of the first sheet material A and the second sheet material B. With reference to FIGS. 5 and 6, the forming operation is performed in two stages. First the flange F is formed from a generally upright position A to a preform position A'. Next the flange F is formed from the preform position A' to a final form position A". The seam S is formed to capture and thus join the first and second sheet materials A, B. As noted above, seaming of the first sheet material A with the second sheet material B is accomplished by either the main roller tool 58 or the touch-up roller tool 60. Selection between the two of these rollers 58, 60 is made depending upon accessibility of the material to be seamed. Specifically, the touch-up roller tool 60 may be selected in the event that the main roller tool 58 is too large for effective cornering and may thus cause undesired deformation of the sheet material B, or in the event that the surface terrain of the combined sheet materials exhibit a tight radial form that flows between inward and outward with respect to the frame, thus rendering use of the larger main roller tool 58 impractical.

An advantage offered by the present invention lies in the off-line programming of the robotic arm 52 which controls the main roller tool 58 and the touch-up roller tool 60. As the main roller tool 58 is engaged to undertake the seaming operation, it is anticipated that the robotic arm 52 will experience a certain amount of structural deflection and backlash of its gearing that in turn introduces positional error. The present invention provides compensation for this error during the initial off-line programming and subsequent programming, thus resulting in accurate seaming that is highly repeatable without loss of accuracy. The error is cancelled by a compensated program which is loaded into the computer 56 that controls the positional articulation of the robotic arm 52 and the variable pressures of the rollers 58, 60, as they form the sheet material.

Once forming and joining of the first sheet material A and the second sheet material B is complete, the upper gate 20 is removed from the second sheet material B and the vacuum source 208 is de-energized causing the first sheet material A to be re-mobilized from the nest surface 32. The joined sheet materials A and B are unloaded from the top of the nest surface 32 and the next pair of sheet materials A and B is loaded. The joining and seaming operation is thus repeated.

Those skilled in the art can now appreciate from the foregoing description that the broad teachings of the present invention can be implemented in a variety of forms. Therefore, while this invention has been described in connection with the particular examples thereof, the true scope of the invention should not be so limited since other modifications will become apparent to the skilled practitioner upon a study of the drawings, specification and following claims.

What is claimed is:

1. An apparatus for forming and joining a first sheet material to a second sheet material, the apparatus comprising:

a nest for holding the first sheet material;

a robotic arm operatively associated with said nest;

a faceplate rotatably attached to said robotic arm, said faceplate having a long axis; and a positional pressure roller tool for forming and joining the first sheet material to the second sheet material, said positional pressure roller tool including a cylinder rigidly attached to said faceplate, a reciprocating hub including a piston end and a roller tool end, said reciprocating hub being reciprocatingly mounted in said cylinder, and a main roller tool, said main roller tool being mounted to said roller tool end of said reciprocating hub, said reciprocating hub having a long axis, said long axis of said reciprocating hub and said long axis of said faceplate being in axial alignment, said roller tool including a roller, said roller being positioned off-axis with respect to said long axis of said reciprocating hub.

2. The apparatus of claim 1 further including a computer having a roller tool-driving program, said computer being operatively associated with said robotic arm and said positional pressure roller tool.

3. The apparatus of claim 1 further including a biasing element for biasing said positional pressure roller tool against the second sheet material and the first sheet material during the forming and joining of the first sheet material to the second sheet material.

4. The apparatus of claim 3 wherein said biasing element is a spring.

5. The apparatus of claim 3 wherein said biasing element comprises a gas-charged cylinder.

6. The apparatus of claim 1 wherein said positional pressure roller tool includes a main roller and a touch-up roller.

7. The apparatus of claim 6 wherein said main roller and said touch-up roller share a common hub, said common hub being rotatably attached to said robotic arm.

8. The apparatus of claim 1 wherein said nest includes a peripheral surface upon which the first sheet material and the second sheet material are placed for forming and joining by said positional pressure roller tool.

* * * * *